US011253772B2

(12) United States Patent
Digby

(10) Patent No.: US 11,253,772 B2
(45) Date of Patent: Feb. 22, 2022

(54) RELEASABLE BOOT AND BINDING ASSEMBLY FOR VARIOUS SPORTS

(71) Applicant: Daniel Digby, Nags Head, NC (US)

(72) Inventor: Daniel Digby, Nags Head, NC (US)

( * ) Notice: Subject to any disclaimer, the term of this patent is extended or adjusted under 35 U.S.C. 154(b) by 0 days.

(21) Appl. No.: 15/750,383

(22) PCT Filed: Apr. 20, 2017

(86) PCT No.: PCT/US2017/028685
§ 371 (c)(1),
(2) Date: Feb. 5, 2018

(87) PCT Pub. No.: WO2017/184894
PCT Pub. Date: Oct. 26, 2017

(65) Prior Publication Data

US 2019/0070485 A1 Mar. 7, 2019

Related U.S. Application Data

(60) Provisional application No. 62/357,658, filed on Jul. 1, 2016, provisional application No. 62/325,101, filed on Apr. 20, 2016.

(51) Int. Cl.
*A63C 9/00* (2012.01)
*A63C 10/10* (2012.01)
(Continued)

(52) U.S. Cl.
CPC ..... *A63C 10/106* (2013.01); *A43B 5/00* (2013.01); *A43B 5/0427* (2013.01); *A63C 10/06* (2013.01);
(Continued)

(58) Field of Classification Search
CPC ..... A63C 10/106; A63C 10/10; A63C 10/24; A63C 10/08; A63C 10/14; A63C 10/06;
(Continued)

(56) References Cited

U.S. PATENT DOCUMENTS 4,973,073 A 11/1990 Raines et al.
5,044,654 A 9/1991 Meyer
(Continued)

FOREIGN PATENT DOCUMENTS

EP 1247552 A1 9/2002
FR 2732230 10/1996
WO WO 9915245 A1 4/1999

OTHER PUBLICATIONS

ISR for International Application PCT/US17/28685, dated Aug. 29, 2017 from USPTO as the International Searching Agent.
(Continued)

*Primary Examiner* — James M Dolak
(74) *Attorney, Agent, or Firm* — Tyler Dunham, Esq.

(57) ABSTRACT

Provided herein are various embodiments for a boot for releasable engagement with a binding having a downwardly facing ledge and a toe strap. The boot preferably contains a sole, a toe portion, and a heel portion. The boot preferably also contains a heel retaining device extending rearwardly from the heel portion of the boot and having an upwardly facing engagement surface at the top of the device which engages with the downwardly facing ledge of the binding to prevent vertical movement of the boot relative to the binding while allowing forward horizontal movement of the boot relative to the binding.

17 Claims, 8 Drawing Sheets

(51) Int. Cl.

| | |
|---|---|
| ***A63C 10/06*** | (2012.01) |
| ***A63C 10/24*** | (2012.01) |
| ***B63B 32/40*** | (2020.01) |
| ***A43B 5/00*** | (2022.01) |
| ***A43B 5/04*** | (2006.01) |
| ***A63C 10/08*** | (2012.01) |
| ***A63C 10/14*** | (2012.01) |

(52) U.S. Cl.
CPC ..... *A63C 10/08* (2013.01); *A63C 10/10* (2013.01); *A63C 10/14* (2013.01); *A63C 10/24* (2013.01); *B63B 32/47* (2020.02)

(58) Field of Classification Search
CPC ..... A63C 10/00; A63C 10/02; A63C 10/04; A43B 5/00; A43B 5/0427; A43B 5/0403; A43B 5/04; A43C 11/00; A43C 11/14; A43C 11/1493
See application file for complete search history.

(56) References Cited

U.S. PATENT DOCUMENTS 5,261,689 A 11/1993 Carpenter et al.
5,401,041 A 3/1995 Jespersen
5,409,244 A 4/1995 Young
5,417,443 A 5/1995 Blattner et al.
5,454,322 A 12/1995 Perkins et al.
5,480,176 A 1/1996 Sims
5,505,478 A 4/1996 Napoliello
5,609,347 A 3/1997 Dressel
5,660,410 A * 8/1997 Alden ..... A63C 9/18 280/627
5,692,765 A * 12/1997 Laughlin ..... A63C 10/04 280/619
5,695,210 A 12/1997 Goss et al.
5,820,155 A 10/1998 Brisco
5,832,635 A * 11/1998 Finney ..... A43B 5/0401 36/118.8
5,901,971 A 5/1999 Eaton
5,909,886 A * 6/1999 Tugutaka ..... A63C 10/24 280/14.21
5,915,721 A 6/1999 Laughlin et al.
5,947,508 A 9/1999 Graf et al.
5,967,531 A * 10/1999 Saillet ..... A63C 10/24 280/11.36
6,003,893 A 12/1999 Hansen
6,007,077 A 12/1999 Moe
6,056,312 A 5/2000 Hogstedt
6,065,770 A 5/2000 Hansen et al.
6,105,995 A 8/2000 Zill
6,168,173 B1 1/2001 Reuss et al.
6,213,493 B1 4/2001 Korman
6,257,613 B1 7/2001 Porte
6,267,403 B1 * 7/2001 Bossin ..... A63C 10/22 280/14.22
6,276,708 B1 * 8/2001 Hogstedt ..... A63C 10/06 280/14.22
6,279,924 B1 8/2001 Murphy et al.
6,293,577 B1 * 9/2001 Shields ..... A63C 10/04 280/14.22
6,308,980 B1 10/2001 Karol
6,338,497 B1 1/2002 Chevalier et al.
6,375,212 B1 4/2002 Hillairet et al.
6,382,641 B2 * 5/2002 Dennis ..... A63C 10/10 280/11.36
6,457,736 B1 10/2002 Maravetz et al.
6,464,237 B1 10/2002 Gracie
6,520,511 B2 * 2/2003 Gonthier ..... A63C 10/24 280/11.36
6,663,118 B1 * 12/2003 Otsuji ..... A43B 5/0401 280/14.22
6,739,615 B1 * 5/2004 Maravetz ..... A43B 5/0401 280/11.36
6,855,023 B2 2/2005 Berger et al.
6,863,285 B2 * 3/2005 Gonthier ..... A43B 5/0403 280/14.22
6,910,706 B2 * 6/2005 Holzer ..... A63C 5/128 280/14.24
6,945,837 B2 9/2005 Crumrine et al.
7,011,334 B2 3/2006 Holzer
7,204,495 B2 * 4/2007 Reuss ..... A43B 5/04 280/11.36
7,232,148 B2 * 6/2007 Gonthier ..... A43B 5/0403 280/636
7,334,810 B2 * 2/2008 Holzer ..... A63C 5/128 280/14.24
7,338,067 B2 3/2008 Flaig
7,571,924 B2 * 8/2009 White ..... A63C 10/18 280/611
7,614,638 B2 11/2009 Cunningham et al.
7,658,398 B2 2/2010 Panzeri
7,766,711 B2 8/2010 Crumrine
7,802,808 B2 9/2010 Neiley
7,837,218 B2 11/2010 Flaig
8,172,252 B2 5/2012 Elkington
8,215,660 B2 * 7/2012 Cunningham ..... A63C 10/06 280/617
8,336,903 B2 12/2012 Furr et al.
9,149,711 B1 * 10/2015 Kavarsky, Jr. ..... A63C 10/24
9,242,168 B1 1/2016 Kavarsky et al.
9,248,366 B2 2/2016 Walker
9,492,730 B2 * 11/2016 Kavarsky, Jr. ..... A63C 10/10
10,179,272 B2 * 1/2019 Kavarsky, Jr. ..... A63C 10/08
10,702,762 B2 * 7/2020 Kavarsky, Jr. ..... A63C 10/103
10,864,429 B2 * 12/2020 Dreifus ..... A63C 10/005
11,090,549 B2 * 8/2021 Lee ..... A63C 7/1013
11,123,628 B2 * 9/2021 Frappier ..... A63C 10/24
2002/0153704 A1 10/2002 Okajima et al.
2002/0180182 A1 12/2002 Dennis et al.
2003/0094788 A1 5/2003 Jacobs
2004/0155433 A1 8/2004 Sanders
2007/0187911 A1 8/2007 Morley
2008/0277904 A1 11/2008 Etges

OTHER PUBLICATIONS

Extended European Search Report; European Patent Office (Munich); App No. EP 17 78 6656; dated Nov. 25, 2019 pp. 1-8.

* cited by examiner

RELEASABLE BOOT AND BINDING ASSEMBLY FOR VARIOUS SPORTS

CROSS-REFERENCE TO RELATED APPLICATIONS

This application claims priority to, and is a National Stage filing of International Application No. PCT/US17/28685 filed on Apr. 20, 2017 which claimed priority to US Provisional Application No. 62/325,101 filed on Apr. 20, 2016 which is herein incorporated by reference in its entirety. International Application No. PCT/US17/28685 filed on Apr. 20, 2017 also claimed priority to US Provisional Application No. 62/357,658 filed on Jul. 1, 2016 which is herein incorporated by reference in its entirety.

TECHNICAL FIELD

Embodiments generally relate to releasable boot and binding assemblies for various sports, including but not limited to action sports such as kiteboarding, kitesurfing, wakeboarding, surfing, landboarding, splitboarding, and snowboarding.

BACKGROUND OF THE ART

Binding systems are generally used to attach a user to an object, generally a planar object that is placed below their feet. Some action sports require a binding system that can quickly and easily be both inserted/attached as well as removed/released. Prior art binding systems that were easily released and inserted did not provide enough support to many users. Prior art binding systems that provided adequate support were not easily released and inserted.

SUMMARY OF THE EXEMPLARY EMBODIMENTS

Exemplary embodiments provide a releasable boot and binding system for use with various sports. The boot preferably contains a heel retaining device which engages with the heel portion of the binding. In a preferred embodiment, the binding contains a ledge which engages with a wedge that forms a portion of the heel retaining device. The heel retaining device could be a separate component that attaches to a traditional boot or it could be embedded within a portion of the boot. The bindings would preferably contain some type of toe strap, which can take on many forms. An exemplary embodiment would engage the toe of the boot with the toe strap first, then by lowering the heel of the boot the heel retaining device can engage with the binding. The boot could then be released by simply removing the toe strap and sliding the boot horizontally and forward (towards the toe side of a board).

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
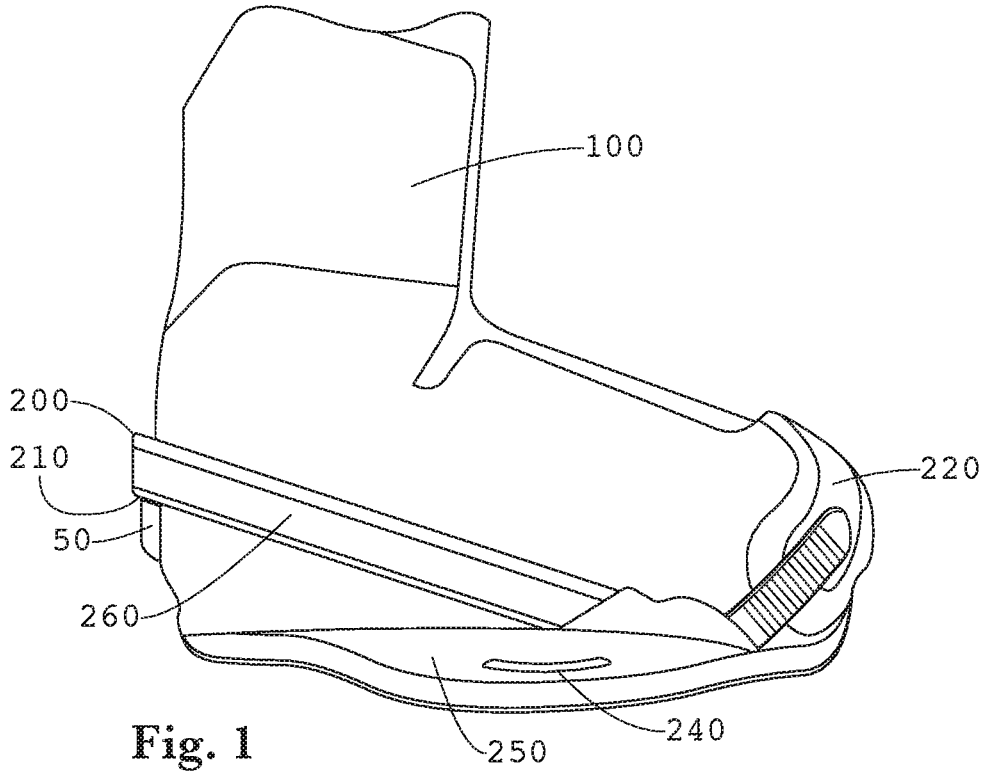
FIG. 1 provides a left side plan view of an exemplary embodiment of a boot while engaged with an exemplary embodiment of the binding.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 provides a left side plan view of an exemplary embodiment of a boot 100 while engaged with an exemplary embodiment of the binding 200. In this embodiment, the binding 200 contains a traditional slot 240 for mounting the binding 200 to a planar surface, typically a board of some type. A plate 250 may connect with the slot 240 and may traverse underneath the entire sole of the boot 100, or only underneath a small portion of the sole of the boot 100. A toe strap 220 may be used to secure the toe portion of the boot 100. The binding 200 preferably contains a rear ledge or ledge 210, which is elevated above the top surface of the board and generally faces downwardly. The ledge 210 preferably engages with the heel retaining device 50 once the heel of the boot 100 has been lowered to a point where the heel retaining device 50 is below the ledge 210. It should be noted that the bindings 200 can have the traditional "high back" (as used in snowboarding and wakeboarding) or no high back (as shown in FIG. 1). However, as shown and described further below, many different types of bindings could be used with the various embodiments herein, as the presence of a high back or lack of a high back can be effective with any embodiment depending on the application. In an exemplary embodiment, no high back would be used, only the arms 260 as shown and described below. It should also be noted that in a preferred embodiment, each element of the binding 200 is rigidly fixed relative to one another, with the exception of the toe strap 220. Thus, the ledge 210 should be rigidly fixed relative to the arm 260, which is rigidly fixed relative to the plate 250, making the ledge 210 also rigidly fixed relative to the plate 250. In this way, when the binding 200 is attached to a board, the ledge 210 should preferably not move relative to the top surface of the board 400.

Figure 2:
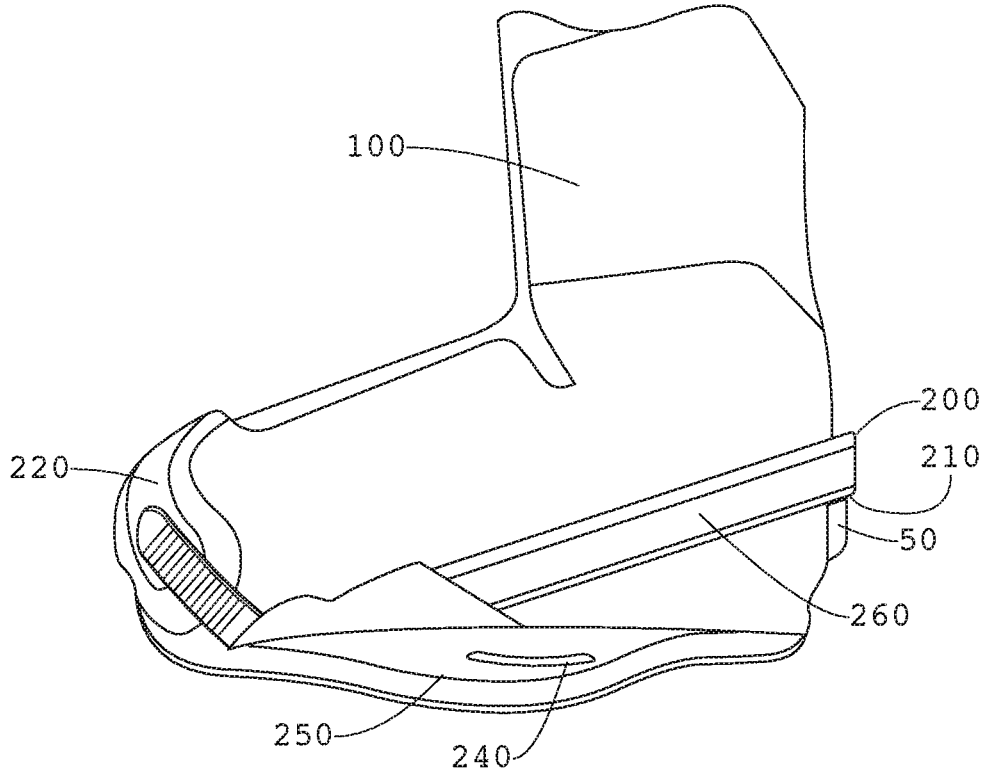
FIG. 2 provides a right side plan view of the embodiments shown in FIG. 1.

FIG. 2 provides a right side plan view of the embodiments shown in FIG. 1. The toe strap 220 preferably connects between two opposing sides of the binding 200 and is placed over the toe area of the boot 100. It should be noted that the toe strap 220 could wrap around the front surface of the toe of the boot 100, the top surface of the toe of the boot 100, or a combination of the top surface and the front surface of the toe of the boot 100 (as shown). Any version of the toe strap 220 would work with the exemplary embodiments herein. In this embodiment of the binding 200, the plate 250 is shown extending under the toe and heel portions of the boot 100.

Figure 3:
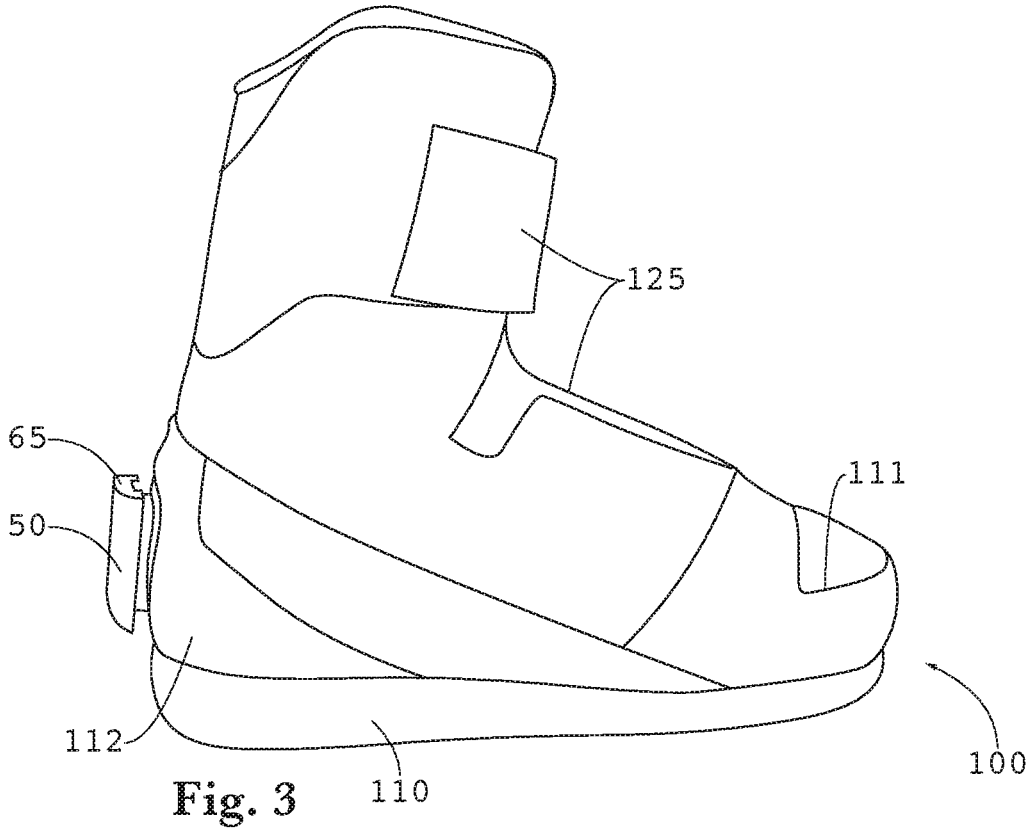
FIG. 3 provides a left side plan view of the embodiment of the boot shown in FIGS. 1-2.

FIG. 3 provides a left side plan view of the embodiment of the boot 100 shown in FIGS. 1-2. The boot 100 preferably contains a sole 110, a toe portion 111, a heel portion 112, and securing devices 125 which can be any combination of hook and loop fasteners, tightening clips, a traditional knot in laces, a boa system (cables which are tightened onto the user's foot by rotating a knob), or anything similar that could be used to secure the boot 100 onto the foot of a user. The sole 110 is preferably smooth all around the perimeter with nothing protruding outwardly from the sole 110. An engagement surface 65 is preferably located as the top surface of the heel retaining device 50, and preferably engages with the ledge 210 on the binding 200 as shown and described herein.

Figure 4:
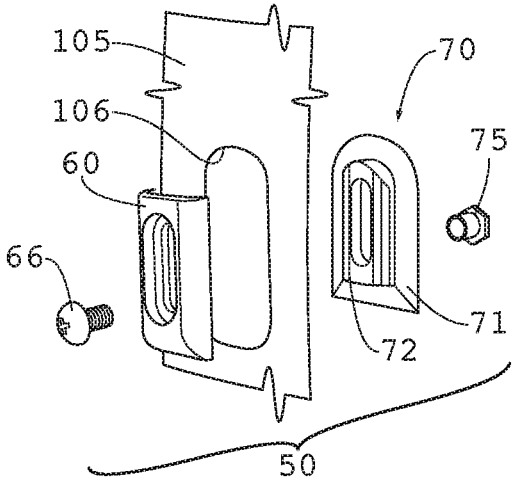
FIG. 4 provides an exploded view of an exemplary embodiment of the heel retaining device.

FIG. 4 provides an exploded view of an exemplary embodiment of the heel retaining device 50. The wedge 60 contains the engagement surface 65 as described above and preferably contains a plurality of teeth on the back side of the wedge 60 to engage with a plurality of teeth which extend from the interior plate 70. Generally, the interior plate 70 is fixed relative to the boot 100 and may be effectively sewn into the boot 100. The interior plate 70 preferably contains a flat portion 71 which extends around the perimeter of a central portion 72 which extends rearwardly and contains the teeth which engage with the teeth on the back side of the wedge 60. The exterior boot wrap 105 may contain an aperture 106 which is sized to allow the central portion 72 of the interior plate 70 to be accessible.

A female threaded fastener 75 may be fixed within the central portion 72 or may slide within a slot found in the central portion 72. When using a female threaded fastener 75 that can slide within the slot, the fastener 75 can be located at various vertical heights to account for the user's boot size/binding size combination, or other factors that could result in the boot 100 engaging with the binding 200 at different vertical heights. Thus, to attach the wedge 60 to the boot 100 initially or re-locate the vertical height of the wedge 60, a male threaded fastener 66 may pass through the center of the wedge 60 to engage with the female threaded fastener 75. As the male fastener 66 is threaded into the female fastener 75, the opposing teeth of the wedge 60 and interior plate 70 become interlocked so that the wedge 60 can no longer move relative to the interior plate 70 (or the boot 100). The underside of the head of the male fastener 66 preferably contains the rear surface of the wedge 60, in order to draw the wedge 60 against the interior plate 70.

It is preferred that the heel retaining device 50 is rigidly attached to the boot 100 so that the device 50 cannot substantially move relative to the boot 100 (other than the adjustment of the height of the cleat 60 by adjusting the fasteners 66/75) upon installation.

Figure 5:
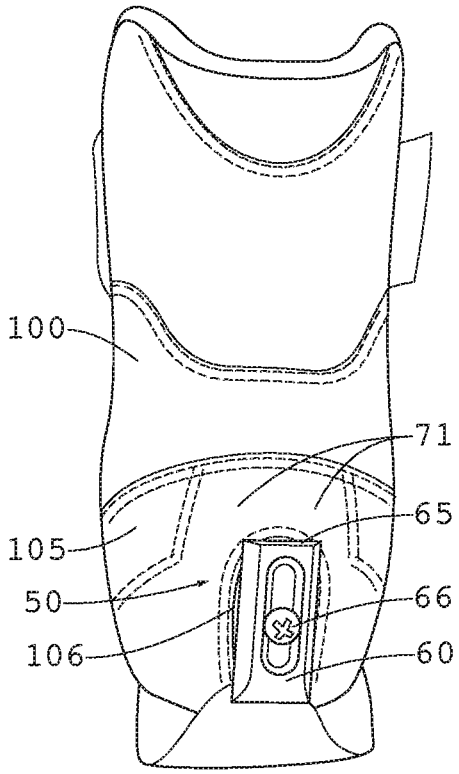
FIG. 5 provides a rear view of a boot that includes the heel retaining device shown in FIG. 4.

FIG. 5 provides a rear view of a boot 100 that includes the heel retaining device 50 shown in FIG. 4. As shown, the flat portion 71 of the interior plate 70 is preferably located behind/underneath the exterior boot wrap 105 while the aperture 106 allows access to the central portion 72 of the interior plate 70. By loosening the male fastener 66, the wedge can either be removed or can be re-located to a different vertical height by engaging with teeth on the wedge 60 and central portion 72 that are at different vertical heights.

Figure 6:
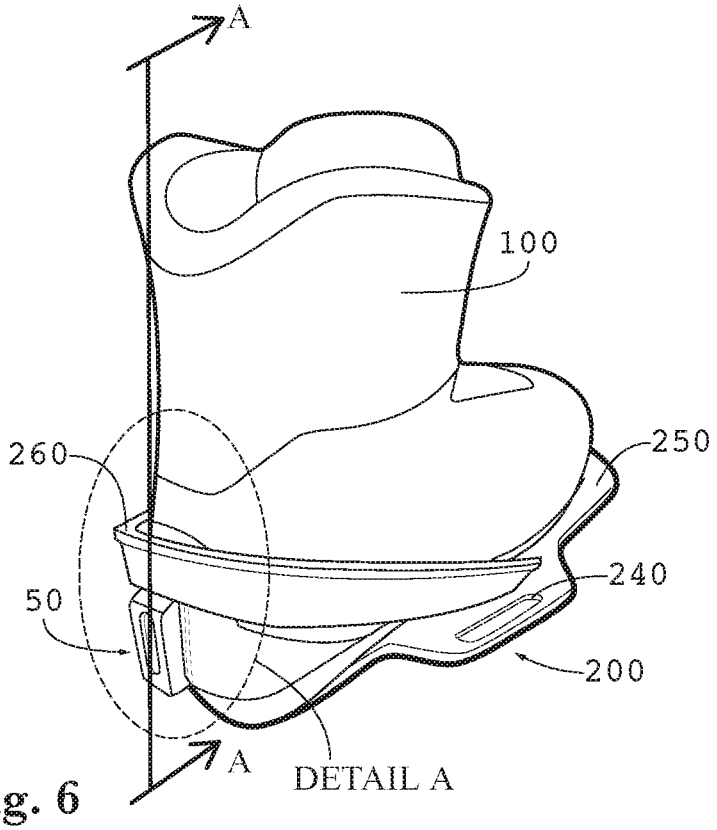
FIG. 6 provides a rear perspective view of an exemplary embodiment of a boot engaged with an exemplary embodiment of the binding, and indicating the location of section line A-A, which cuts horizontally through the center of the boot and binding, along with the location of Detail A.

FIG. 6 provides a rear perspective view of an exemplary embodiment of a boot 100 engaged with an exemplary embodiment of the binding 200, and indicating the location of section line A-A, which cuts horizontally through the center of the boot 100 and binding 200, along with the location of Detail A. Here we see a plate 250 which extends from the slots 240 and passes underneath a portion of the sole of the boot 100, but not the entire boot 100. An arm 260 preferably wraps behind the heel of the boot 100 and is attached to the plate 250, at a position close to the slots 240, on the left and right hand sides of the binding 200. In this embodiment, a bottom surface of the arm 260 preferably provides the ledge 210 for engagement with the engagement surface 65 on the wedge 60.

Figure 7:
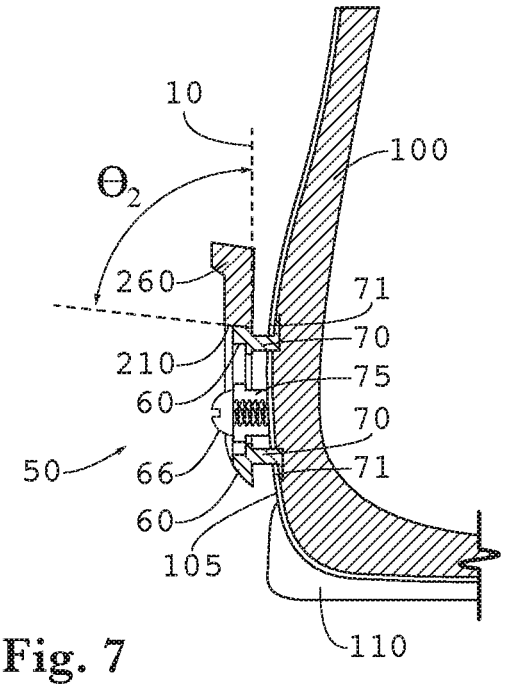
FIG. 7 provides a detailed section view taken along the section line A-A and indicating the features in Detail A.

FIG. 7 provides a detailed section view taken along the section line A-A and indicating the features in Detail A. In this embodiment, a bottom surface of the arm 260 preferably provides the ledge 210 for engagement with the engagement surface 65 on the wedge 60. Here, the angle $\theta_2$ is defined as the angle of the ledge 210 relative to a vertical axis 10 and rotated away from the rear of the boot 100. The angle $\theta_2$ will be described further below.

Figure 8:
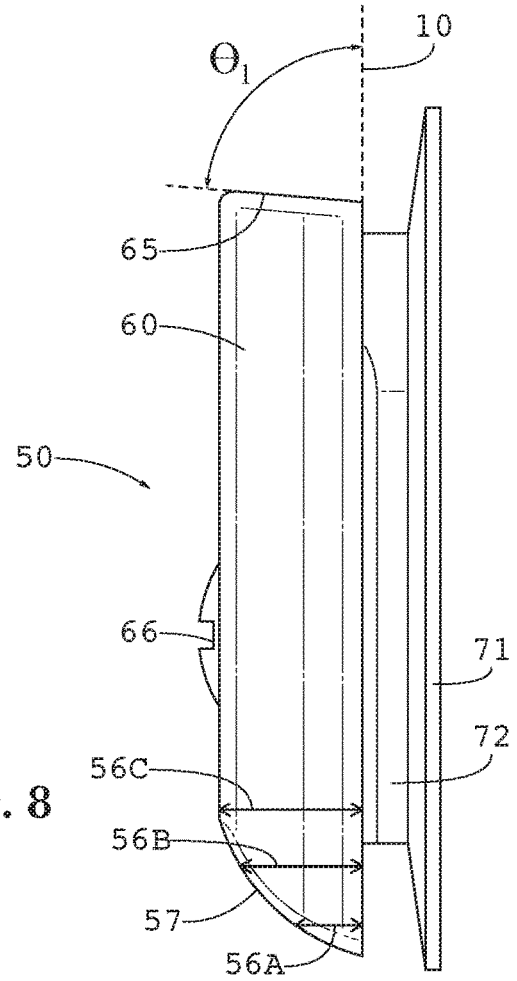
FIG. 8 provides a left side plan view of an exemplary embodiment of a heel retaining device.

FIG. 8 provides a left side plan view of an exemplary embodiment of a heel retaining device 50. As noted above, the wedge 60 also preferably contains an engagement surface 65 at the top of the wedge 60. Here, the angle $\theta_1$ is defined as the angle of the engagement surface 65 relative to a vertical axis 10 and rotated away from the rear of the boot 100. The engagement surface 65 can be substantially horizontal (i.e. $\theta_1$ is approximately 90 degrees from the vertical axis 10). However, in a preferred embodiment, the engagement surface 65 would have $\theta_1$ between 80 degrees and 85 degrees rearwardly away from the vertical axis 10. Regarding $\theta_2$ from above, whatever angle is chosen for $\theta_1$ would also be the preferred angle for $\theta_2$, or at least making $\theta_1$ substantially equal to $\theta_2$ or within a few degrees of each other. This is not required however, as some embodiments could use different values for the two, as an example, 80 degrees for $\theta_1$ with 90 degrees for $\theta_2$ Generally speaking, $\theta_1$ and/or $\theta_2$ could be anywhere between 60 degrees and 90 degrees in various embodiments, depending on the application.

In a preferred embodiment, the engagement surface 65 would be upwardly facing as shown and would be fixed relative to the boot so that the engagement surface 65 does not move relative to the boot 100. As shown and described herein, the engagement surface 65 should prevent an upward vertical movement of the boot 100 relative to the binding 200, but would not substantially prevent forward horizontal movement of the boot 100 relative to the binding 200.

The bottom portion of the wedge 60 preferably contains a transition portion 57 which begins at the lowest point on the wedge 60 and continues upwardly until the full width of the wedge 60 has been reached. As shown, when beginning at the bottom point and moving upwardly, the cross-sectional thickness 56 increases as you move upwardly towards the engagement surface 65. Thus, the transition portion 57 begins at zero and then increases to 56A. As you continue to move upwardly, the cross-sectional thickness increases to 56B. As you continue to move upwardly, eventually the cross-sectional thickness of the transition portion 57 becomes substantially equal to the cross-sectional thickness of the wedge 60, which is shown as 56C. It should be noted, that although shown as a smooth rounded shape, the transition portion 57 can take on any number of different shapes, including a triangular or trapezium shape. All that is required is that the transition portion 57 increases in cross-sectional thickness as you move upwardly towards the engagement surface 65.

Figure 9:
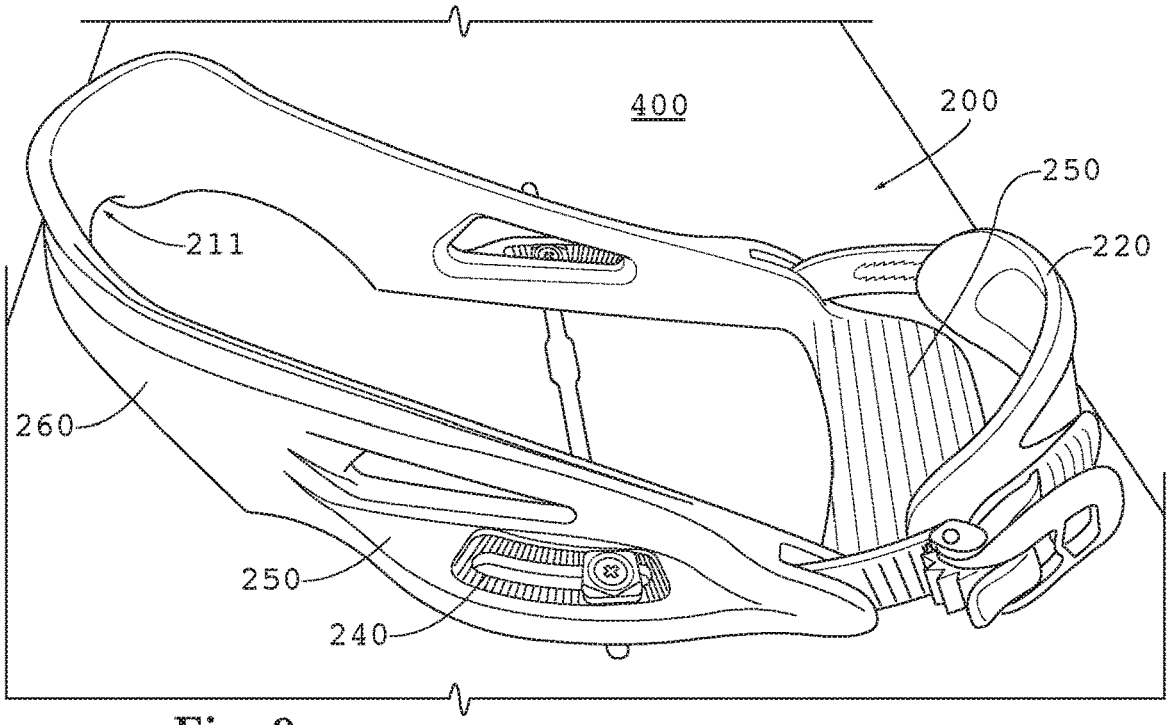
FIG. 9 provides a perspective illustration of another embodiment of the binding.
Figure 10A:
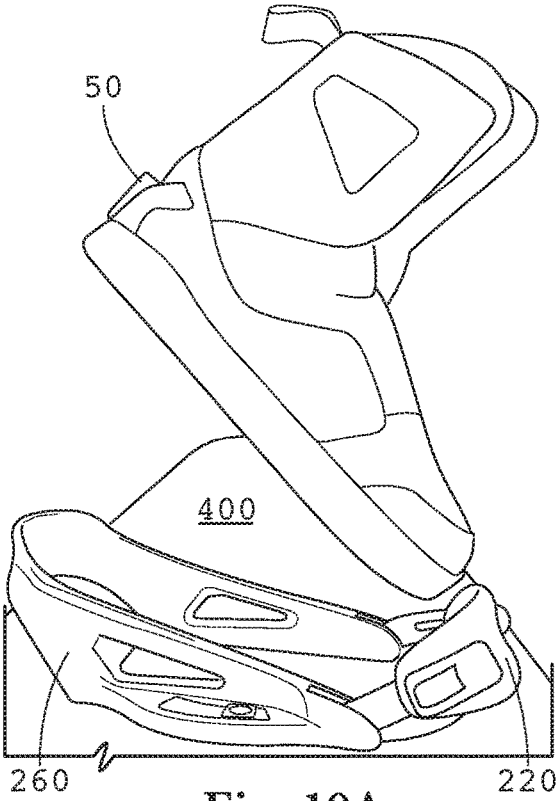
FIGS. 10A through 10D provide a sequence of illustrations showing one embodiment for engaging the boot within the binding.
Figure 10B:
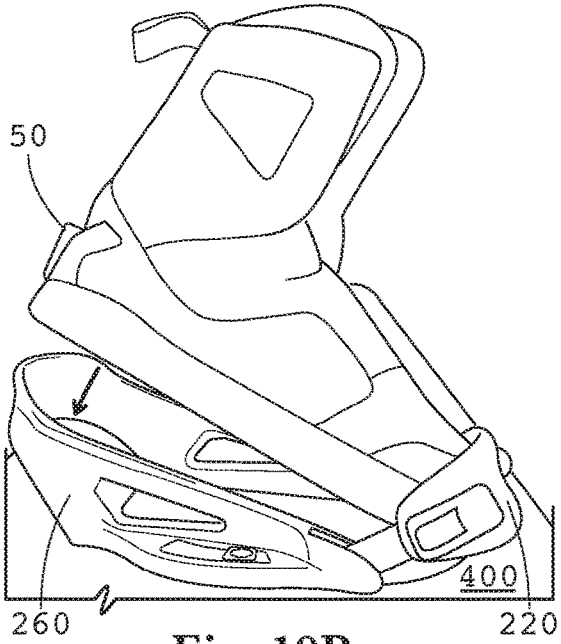
Figure 10C:
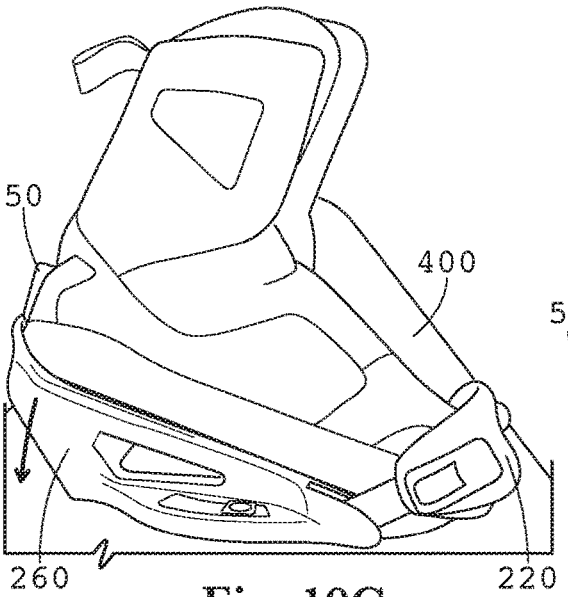
Figure 10D:
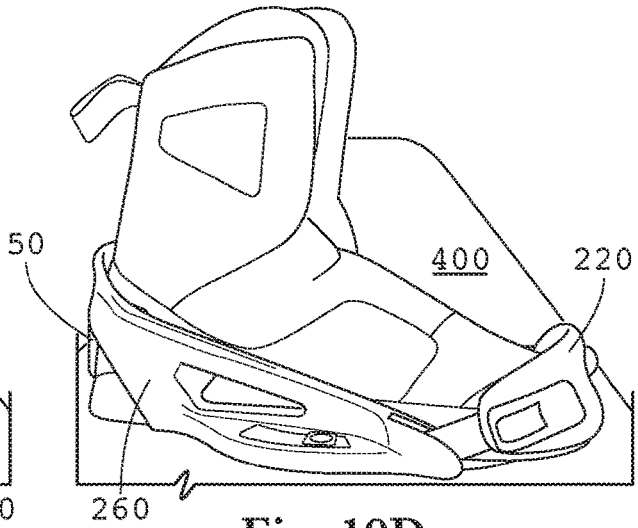
Figure 11A:
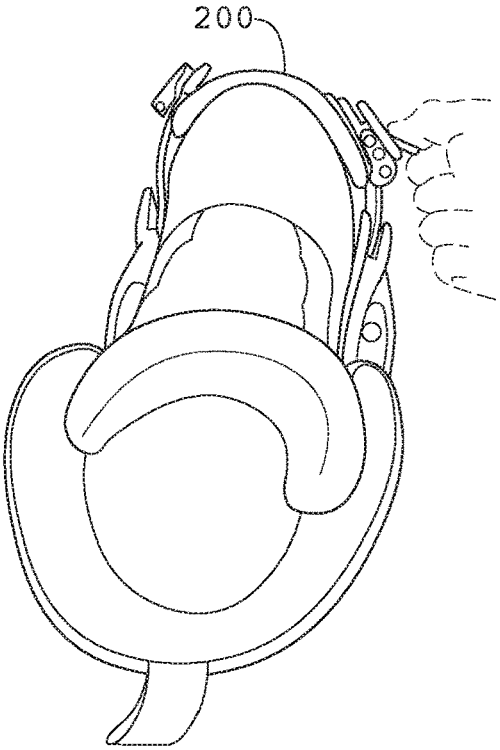
FIGS. 11A through 11D provide a sequence of illustrations showing one embodiment for disengaging the boot from the binding.
Figure 11B:
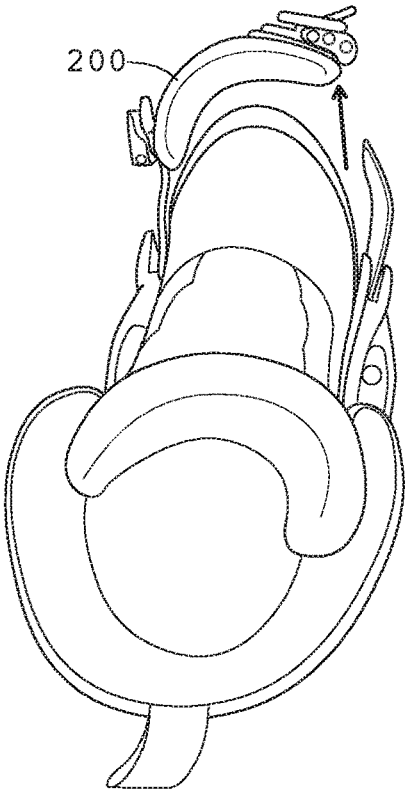
Figure 11C:
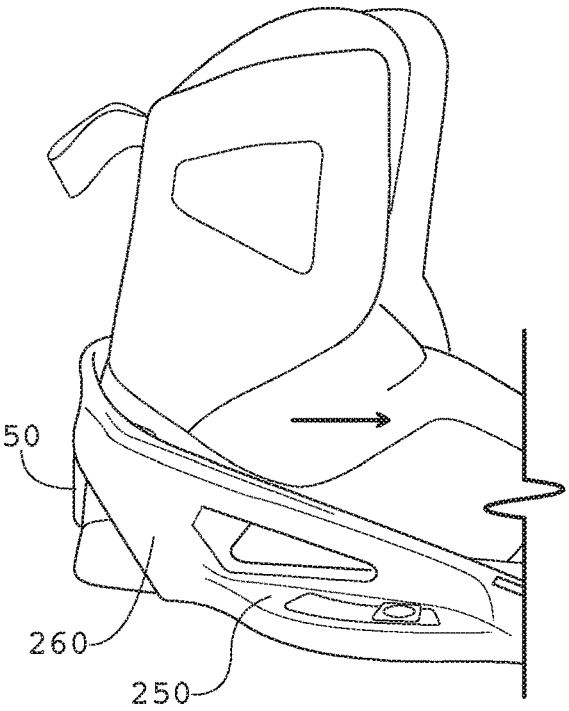
Figure 11D:
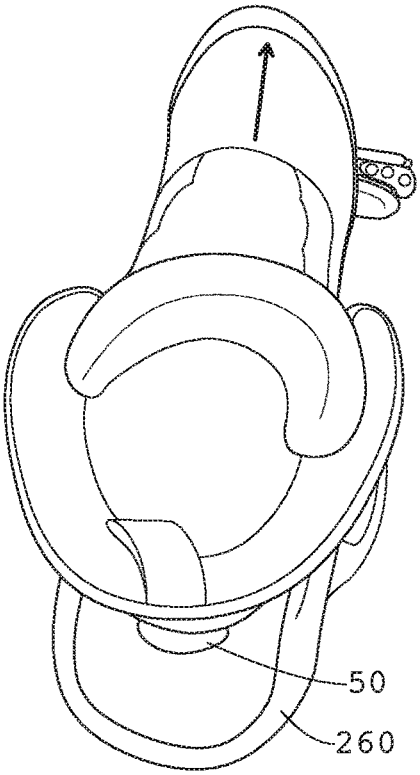

FIG. 9 provides a perspective illustration of another embodiment of the binding 200. In this embodiment, the plate 250 only passes underneath a small toe portion of the boot 100, where otherwise the boot 100 is resting atop the board surface 400 for all other areas of the boot 100, once engaged with the binding 200. Further, this embodiment includes a notch 211 within the arm 260 of the binding 200, to further secure the heel retaining device 50 within the binding 200. The notch 211 can add some lateral strength to the connection between the boot 100 and binding 200, if necessary.

FIGS. 10A through 10D provide a sequence of illustrations showing one embodiment for engaging the boot 100 within the binding 200. During insertion, the toe of the boot 100 is inserted under a portion of the toe strap 220, which can take on many forms. A traditional ratchet strap (shown here) could be used, or a basic semi-rigid strap, or an elastomeric strap. Here, we have a ratchet toe strap 220, but it is not necessary to ratchet the strap during insertion of the boot 100. Thus, for an exemplary embodiment, when the toe of the boot 100 is inserted into the toe strap 220, the toe of the boot 100 can simply be slipped under the toe strap 220 without needing to ratchet (or otherwise tighten) the toe strap 220. Once the toe of the boot 100 has been inserted under a portion of the toe strap 220, the heel of the boot 100 is lowered until the heel retaining device 50 engages with the ledge 210. In this embodiment, the heel retaining device 50 would preferably slip past the arm 260 while the heel of the boot 100 is lowered, but would extend rearwardly once it has passed the ledge 210 on the arm 260, so that the top portion of the heel retaining device 50 is adjacent to (and possibly contacting) the ledge 210. Once inserted, the top portion of the heel retaining device 50 may contact the ledge 210 when there is an upward movement by the user, but the boot 100 would be retained within the binding 200.

FIGS. 11A through 11D provide a sequence of illustrations showing one embodiment for disengaging the boot 100 from the binding 200. During removal, the toe strap 220 can be removed or disengaged, and the boot 100 can slide laterally (horizontally) forward to slide the heel retaining device 50 underneath the ledge 210. As shown below, the toe strap 220 could be removed in a number of ways, depending on the precise type of toe strap 220 that is selected. Using the ratchet strap shown, this would simply be released, and it could be released entirely (so that the toe strap 220 becomes two separate pieces for the boot 100 to slide in between) or simply released/loosened enough so that the toe strap 220 could rotate and slide off the toe of the boot 100, again allowing the boot to move laterally (horizontally) forward and disengage the heel retaining device 50. As noted above, in this way the wedge 60 can be described as constraining the vertical movement of the boot 100 relative to the binding 200, but does not constrain the horizontal or forward movement of the boot 100 relative to the binding 200 in a substantial way. This movement is restrained mostly by the toe strap 220 alone, in an exemplary embodiment.

Figure 12:
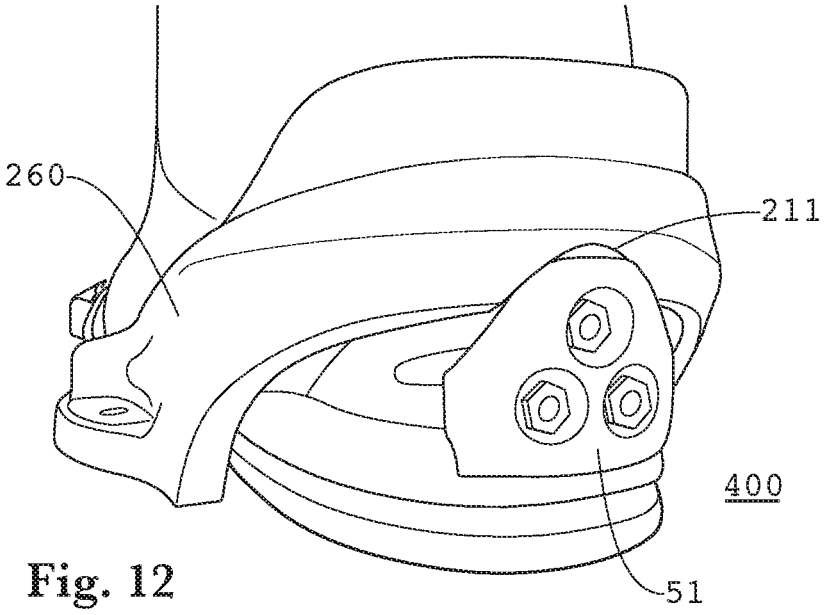
FIG. 12 provides a rear perspective view of another embodiment of the heel retaining device and binding.
Figure 13:
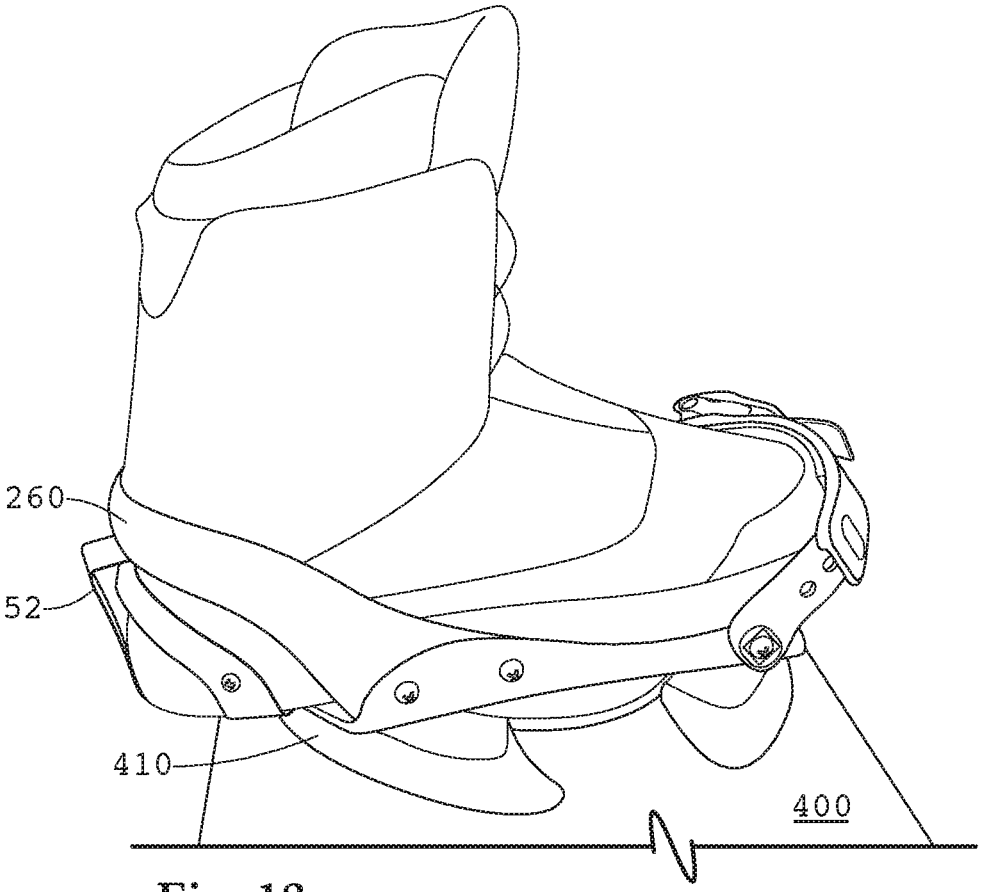
FIG. 13 provides a left side plan view of another embodiment of the heel retaining device and binding.

FIG. 12 provides a rear perspective view of another embodiment of the heel retaining device 51 and binding 200. Here, we see the use of the notch 211 in the arm 260 of the binding along with a different embodiment for the heel retaining device 51. As shown, this embodiment is attached through a series of fasteners and contains a shape at the top of the device 51 which matches the shape used by the notch 211, in order to further secure the device 51 into the arm 260 of the binding 200. Here, notch 211 is sized and shaped similar to the top portion of the heel retaining device 51, which here is a wedge with a pyramid shaped top portion FIG. 13 provides a left side plan view of another embodiment of the heel retaining device 52 and binding. First, note that this embodiment of the binding 200 does not contain the slots for mounting, but instead has the traditional snowboarding mounting holes in the center of the binding. Further, an intermediary element 410 has been placed between the board surface 400 and the binding 200. In this embodiment, the heel retaining device 52 is made of a flexible material so that it can deform slightly in order to slip past the arm 260 when inserting the boot 100 into the binding 200. Here, thin sheet metal has been used, but other flexible plastics, polymers, and composites could also be used. This embodiment of the heel retaining device 52 is simply attached to the heel portion of a traditional boot, without having to sew the device 52 into the exterior wrap of the boot.

Figure 14:
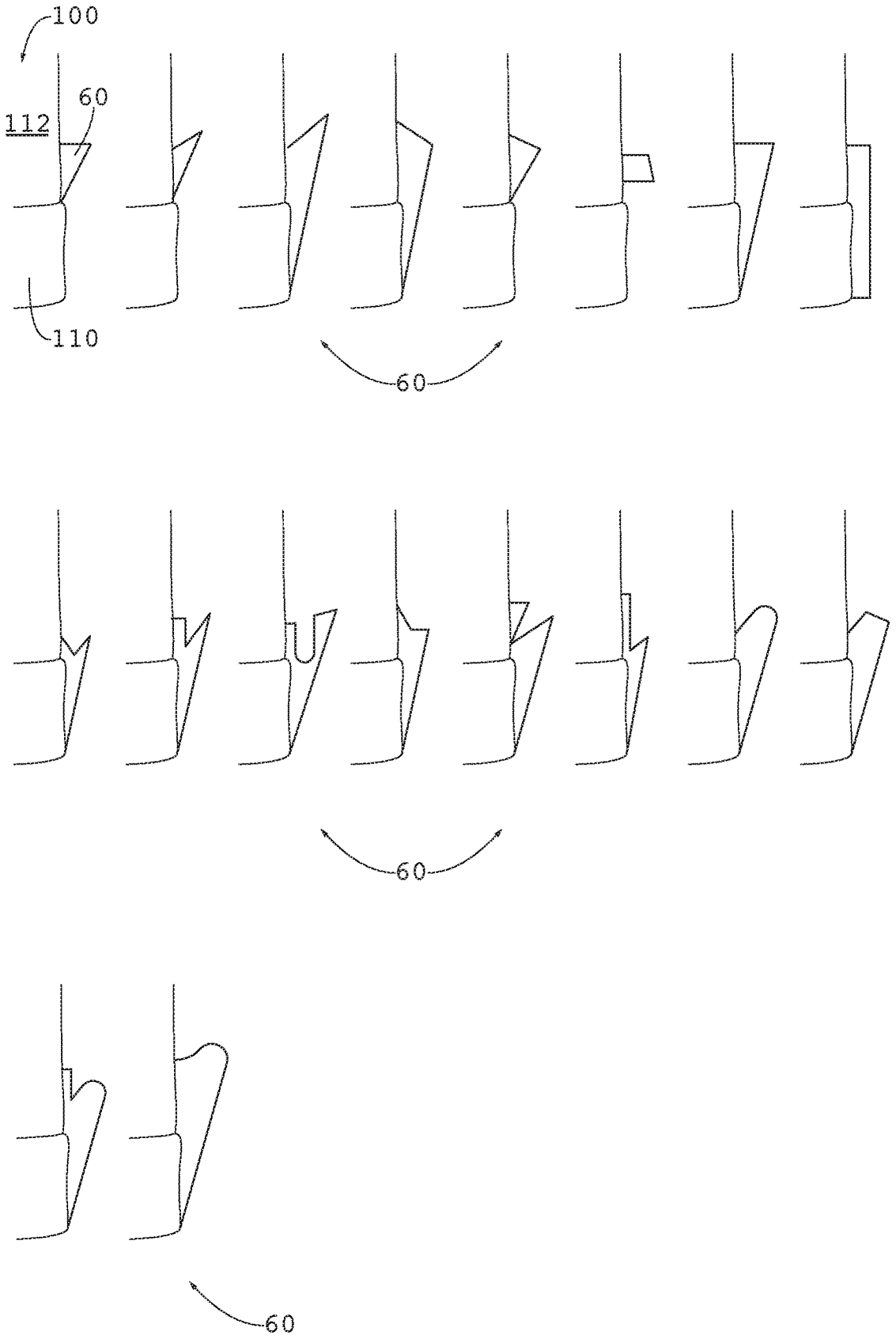
FIG. 14 provides a right side plan view of several alternative embodiments for the wedge.

FIG. 14 provides a right side plan view of several alternative embodiments for the wedge.

The components herein can be composed of many different materials. Specifically, the heel retaining device could be a solid feature and could be comprised of any rigid or semi-rigid material including but not limited to plastics (sometimes filled with glass or other types of strengthening fibers), metals, and composites. In some embodiments, the wedge may have some flexibility, to aid insertion of the boot into the bindings (as described below) but this is not required at all. Preferably, the heel retaining devices are comprised of a material that will not rust, rot, or otherwise degrade in water or substantially degrade from UV exposure, but this is not required. For the exemplary embodiments herein, the heel retaining device is substantially rigid and does not have much flexibility, other than the flex of the boot itself. In some embodiments, the flex of the boot itself provides the ability for the heel retaining device to slip past the arm of the binding (or for the wedge to slip past the ledge on the binding).

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

I claim:

1. A boot and binding system comprising:

a binding having a flat plate, a toe strap connected to a pair of opposing sides of the plate, an arm that connects to the opposing sides of the plate, and a ledge on a bottom side of the arm that is rigidly fixed relative to the arm such that the ledge does not move relative to the arm; and a boot having a toe portion, a heel portion, a sole which connects the toe portion with the heel portion, wherein the sole is smooth around a perimeter with nothing protruding outwardly from the sole for engaging with the binding, and a heel retaining device extending rearwardly from the heel portion of the boot and providing a single upwardly facing engagement surface which does not move relative to the heel portion of the boot.

2. The boot and binding system of claim 1 further comprising:

a pair of slots that extend horizontally along opposing sides of the arm and connect the binding with a board.

3. The boot and binding system of claim 1 wherein:

once the boot is engaged with the binding, the flat plate is under the toe portion of the boot only.

4. The boot and binding system of claim 1 wherein:

once the boot is engaged with the binding, no portion of the binding is underneath the heel portion of the boot.

5. The boot and binding system of claim 1 further comprising:

an exterior boot wrap which covers the heel portion of the boot; and an aperture in the exterior boot wrap which surrounds the heel retaining device.

6. The boot and binding system of claim 1 wherein:

once the boot is engaged with the binding, the heel retaining device has only one surface that contacts only one surface on the ledge of the binding.

7. The boot and binding system of claim 1 further comprising:

an interior plate attached to the heel retaining device and positioned underneath an exterior boot wrap.

8. The boot and binding system of claim 1 further comprising:

an exterior boot wrap which covers the heel portion; and an aperture in the exterior boot wrap which allows the heel retaining device to pass through the exterior boot wrap.

9. The boot and binding system of claim 7 further comprising:

an aperture in the exterior boot wrap which surrounds the heel retaining device.

10. The boot and binding system of claim 9 wherein:

the interior plate is larger than the aperture in the exterior boot wrap.

11. The boot and binding system of claim 8 wherein:

the upwardly facing engagement surface is positioned outside of the exterior boot wrap while the interior plate is underneath the exterior boot wrap.

12. The boot and binding system of claim 1 wherein:

the arm is a continuous member which surrounds the heel portion of the boot once the boot is engaged with the binding.

13. The boot and binding system of claim 1 wherein:

the heel retaining device comprises a wedge that extends from the heel portion of the boot and contains a top portion which provides the engagement surface and a bottom portion having a transition portion where the cross-sectional thickness of the transition portion increases as the wedge extends upwardly towards the engagement surface.

14. The boot and binding system of claim 1 wherein:

the upwardly facing engagement surface is fixed relative to the position of the heel portion of the boot.

15. A method for using a boot and binding system having a binding with a flat plate, a toe strap connected to a pair of opposing sides of the plate, an arm that connects to the opposing sides of the plate, and a ledge on a bottom side of the arm that is rigidly fixed relative to the arm such that the ledge does not move relative to the arm; and a boot having a toe portion, a heel portion, a sole which connects the toe portion with the heel portion, wherein the sole is smooth around a perimeter with nothing protruding outwardly from the sole for engaging with the binding, and a heel retaining device extending rearwardly from the heel portion of the boot and providing a single upwardly facing engagement surface which does not move relative to the heel portion of the boot, the method comprising the steps of:

positioning the toe portion of the boot underneath the toe strap of the binding; and lowering the heel portion of the boot until the engagement surface of the boot is underneath the ledge of the binding, while the ledge does not move rotate relative to the arm of the binding.

16. The method of claim 15 further comprising the steps of:

disengaging the toe strap of the binding; and sliding the boot forward horizontally until the engagement surface of the boot is no longer underneath the ledge of the binding.

17. The method of claim 15 wherein:

the engagement surface does not rotate relative to the heel portion of the boot.

* * * * *